United States Patent [19]

Murr et al.

[11] Patent Number: 4,460,811

[45] Date of Patent: Jul. 17, 1984

[54] COMBINATION SWITCHING CONNECTOR

[76] Inventors: Paul G. Murr, P.O. Box 182; William F. Turner, P.O. Box 732, both of Sanderson, Tex. 79848

[21] Appl. No.: 445,208

[22] Filed: Nov. 29, 1982

[51] Int. Cl.[3] ..... H01R 19/52

[52] U.S. Cl. ..... 200/51.03; 200/11 TW; 200/51.07; 200/153 S; 339/18 P

[58] Field of Search ..... 200/51.03, 51.05–51.07, 200/51.12, 153 S, 302, 11 TW; 339/18 P

[56] References Cited

U.S. PATENT DOCUMENTS

| | | | |
|---|---|---|---|
| 2,660,679 | 11/1953 | Hunt | 339/18 P X |
| 3,132,216 | 5/1964 | Adams | 200/11 TW |
| 3,374,449 | 3/1968 | Moore et al. | 200/153 S X |
| 3,391,262 | 7/1968 | Twitchell | 200/51.03 X |
| 4,008,382 | 2/1977 | De Rosa | 200/51.07 X |
| 4,120,044 | 10/1978 | Harayda | 200/11 TW X |

*Primary Examiner*—John W. Shepperd
*Assistant Examiner*—Renee S. Kidorf
*Attorney, Agent, or Firm*—Wofford, Fails & Zobal

[57] ABSTRACT

A multiple input, multiple output combination switching connector for matingly connecting a plurality of first connectors with a plurality of second connectors characterized by a housing, respective input and output conductors adapted to make electrical contact with the respective first and second conductors, respective wheels for rotating respective input conductors into electrical contact with respective output conductors, each of the wheels including an electrically conductive path connected with a respective input conductor and with an electrically conductive output contact that is adapted to be rotated into electrical contact with respective output conductor. The wheels are individually rotatable within the housing and a bias is provided for maintaining the wheels within the housing and biased together such that electrical continuity through each path per wheel is maintained. A seal is provided, particularly at the window through which the respective wheels are individually rotatable within the housing so as to exclude dirt, moisture and the like. Specific preferred structural embodiments are disclosed.

7 Claims, 11 Drawing Figures

FIG. 1
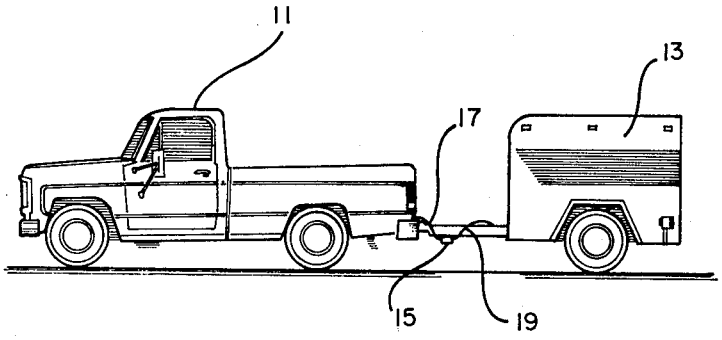
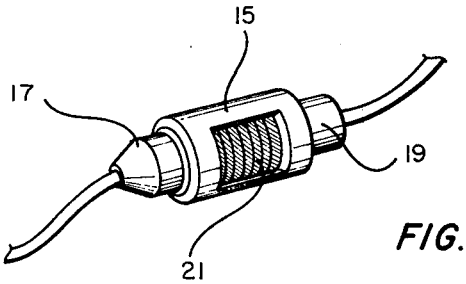
FIG. 2
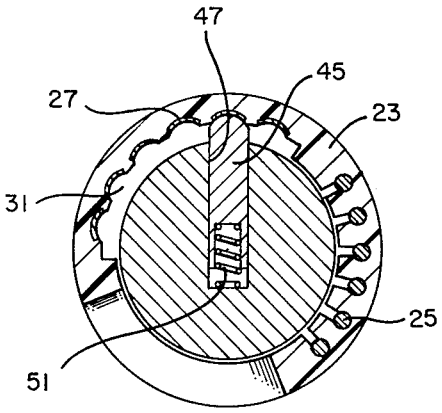
FIG. 4
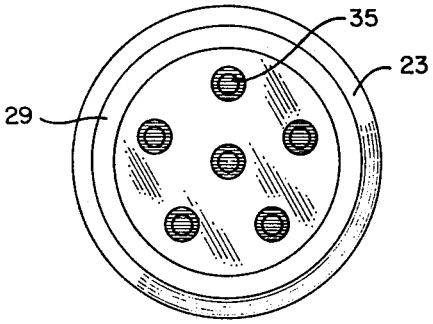
FIG. 5

COMBINATION SWITCHING CONNECTOR

FIELD OF THE INVENTION

This invention relates broadly to a combination switching connector for matingly connecting a plurality of first conductors with a plurality of second conductors, even when they do not match in alignment. More particularly, this invention relates to a combination switching connector for matingly connecting the conductors of a towing vehicle with the conductors of a towed vehicle such that the proper controls energize the proper lights, turn signals, electric brakes and the like.

DESCRIPTION OF THE PRIOR ART

In considering the background of the invention, there are at least two aspects, broad and specific. In the broad aspect the switching connector may be employed in a wide variety of environments to perform as an ultra compact mixer that enables matching up inlet and outlet conductors. For example, it may be used in miniature panels for working in process controls, in the electronics industry as mixers for sound systems and the like. In the specific aspect, it is employed as a switching connector between a towed vehicle and a towing vehicle. Looking at the broad aspect, in the electronic industry, many manufacturers use European DIN connectors having four, six and seven pins and the like whereas the U.S. manufacturers use standardized U.S. plugs such as the RCA plug. This switching connector works as a mixer, or an unscrambler and adapter, to enable combining the two such that any channel can be switched onto any speaker or the like. Such mixers have not been possible heretofore without expensive, elaborate space consuming apparatus with a plurality of expensive, switching means and the like.

Even in the rather mundane field of towed and towing vehicles, such as automative equipment towing trailers, there has not been achieved a degree of standardization between the sockets on the towing vehicle and the towed vehicle. Consequently, it is frequently necessary to rewire the wiring to get the turn signals, for example, connected to turn signals rather than the electric brake; or otherwise correct the mismatch.

Expressed otherwise, the prior art has not provided an economical, readily mating switching connector that can be used to mate input and output conductors to give the desired results. This is particularly true in the field of a vehicle towing a trailer or the like where the switching connectors, or mixers, would be subjected to mud, moisture and be unable to tolerate bulky, space consuming switching means such as the large commercial unscramblers.

SUMMARY OF THE INVENTION

Accordingly, it is an object of this invention to provide a space saving, economical switching connector that can be employed to match input conductors with output conductors in a wide variety of environments and obviate the disadvantages of the prior art.

More particularly, it is an object of this invention to provide a switching connector that can mate the input conductors from controls on a towing vehicle with the output conductors of the systems to be energized on a towed vehicle and obviate the disadvantages of the prior art.

These and other objects will become apparent from the descriptive matter hereinafter, particularly when taken into conjunction with the appended drawings.

In accordance with this invention there is provided a combination switching connector for matingly connecting a plurality of first conduits with a plurality of second conduits, comprising:

a. a housing b. a plurality of respective input conductors adapted to make electrically conductive contact with the first conductors;

c. a plurality of respective output conductors adapted to make electrically conductive contact with the second conductors;

d. a plurality of respective wheel means for rotating a respective input conductor into electrical contact with a respective output conductor, each of the wheel means including an electrically conductive input contact connected with the respective input conductor and including an electrically conductive output contact adapted to be rotated into electrical contact with respective output conductor, the output contact being connected with the input contact by an electrically conductive means for conducting electrical current therethrough, the wheel means being individually rotatable within the housing; and e. means for retaining the wheel means within the housing.

In a preferred embodiment, the wheel means are nonconductive with a slideably mounted conductive member within a slot, the conductive member being biased outwardly to contact contact strips disposed around the outside of the chamber outside the housing. The conductive member is thicker than the remainder of the wheel means so as to maintain electrical contact with a contactor plate that is emplaced adjacent thereto to serve as the electrical conductor means; and the plurality of respective wheel means and electrical contactor plates and are biased together such that electrical contact is maintained throughout rotation. Preferably, a seal means is disposed at the access window for rotating the wheel means and male and female type electrical interconnectors are employed so as to be compatible with the connectors on the respective vehicles. Other types of interconnectors may be employed, as appropriate to the art and matching apparatus.

BRIEF DESCRIPTION OF THE DRAWINGS

FIG. 1 is a side elevational view of a towing vehicle connected with a towed vehicle and employing an embodiment of this invention.

FIG. 2 is a close up view of the embodiment of the switching connector of FIG. 1.

FIG. 4 is a sectional view taken along the lines IV—IV of FIG. 3.

FIG. 5 is an end view of the plug end of FIG. 3.

FIG. 7c is a side elevation view of the other side of the selector wheel of FIG. 7a.

DESCRIPTION OF PREFERRED EMBODIMENTS

Figure 3:
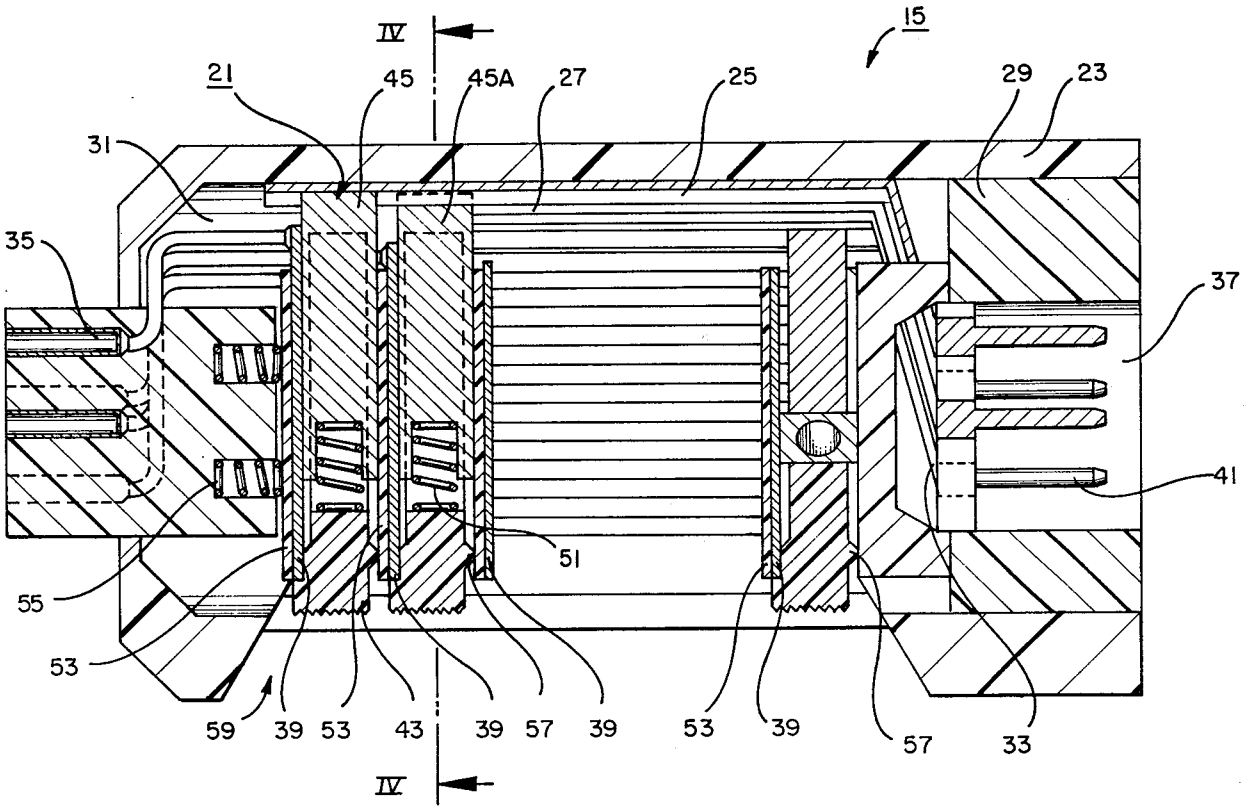
FIG. 3 is a cross-sectional view of the switching connector of FIG. 2.
Figure 6A:
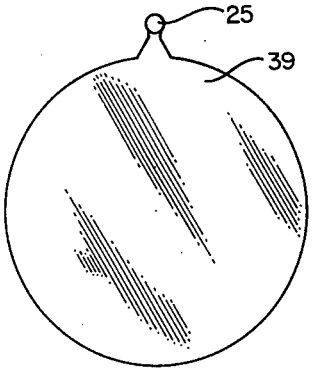
FIGS. 6*a* is an end view of the contactor plate of FIG. 3.
Figure 6B:
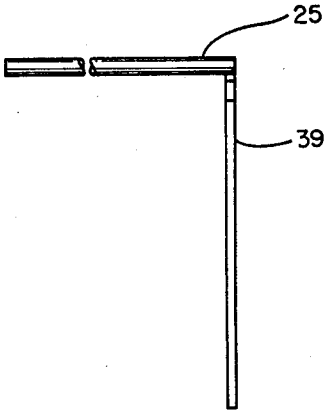
FIG. 6*b* is a side elevational view of the contactor plate of FIG. 6*a*.

While it is to be borne in mind that this invention is widely useful, one of the areas where it finds usefulness is in connecting the controls in a towing vehicle with the proper end system in a towed vehicle. This is true because of the frequency with which interconnections have to be made and it is annoying when the plugs on the respective vehicles do not align and mate. This invention is uniquely advantageous in facilitating the matching of the respective circuits so that the controls in the towing vehicle control the correct end system, such as turn signals, tail lights, electric brakes and the like. Accordingly, it is in this environment that this invention will be described hereinafter. Referring to FIG. 1, a towing vehicle 11 is towingly connected with a towed vehicle 13 as by a trailer hitch or the like. The combination switching connector 15 interconnects the electrical system between a plug 17 on the towing vehicle, such as pickup 11, and plug 19 on the towed vehicle, such as a horse trailer 13 or the like.

As implied, the towing vehicle may be an automobile, pickup truck, short bed truck, or even a tractor capable of towing the towed vehicle 13. The towed vehicle 13 may be a house trailer, recreational trailer, animal trailers or any other form of vehicle that is towed.

The interconnector switch 15, illustrated in more detail in FIG. 2, has respective plugs that matingly engage with the plugs 17 and 19; and has a plurality of respective wheel means 21 that can be rotated, respectively, to achieve mating interconnection between the controls on the towing vehicle and the end system on the towed vehicle as will become clearer hereinafter.

The exact construction of the respective wheel means 21 may be any construction that will enable interconnecting a specific one of input conductors with a specific one of output conductors. Thus, the wheel means can be rotated to effect matching of the respective circuits easily and straightforwardly, as will become clearer from the further detailed descriptive matter hereinafter.

Specifically, referring to FIGS. 3–8, the switching connector 15 includes a housing 23, a plurality of respective input conductors 25, a plurality of output conductors 27 and a means 29 for holding the entire subassembly, including the wheel means, operably within the housing 23.

The housing 23 may comprise any type construction. Preferably, it is a pre-formed plastic housing that does not readily conduct electricity. It is advantageous to form the interior chamber 31 within the housing in the form of a cylindrically shaped chamber in order that the wheel means can be round and readily rotated to interconnect the respective first and second conductors 25, 27 by the respective wheel means 21. The exterior form of housing is of very little consequence. For simplicity herein, it is illustrated as cylindrical although in other fields such as electronics industry, controls, or interconnecting sound channels with speakers, it may be square or other aesthetically pleasing external shape. While metal or electrically conductive housings can be employed if suitable insulators are included, it is economically advantageous to employ insulating housing so that the peripherally disposed output conductors, or second, conductors 27, can be disposed peripherally therearound without the added expense of insulators.

The first conductors 25 are illustrated as wires that are connected, as by solder 33 or the like with respective female conductive receptors 35 that form the connectors in the female plug 37 which is adapted to receive a male plug such as the plug 17, FIGS. 1 and 2. As can be seen more clearly in the embodiment illustrated in FIGS. 4, 6a and 6b, the respective first conductors 25 comprise wires that extend from the pins 35 into electrical connection with a contactor plate 39. One each of the contactor plates 39 is disposed adjacent each of the respective wheel means 21 for maintaining electrical contact throughout rotation of the respective wheel means 21 in rotating the output contact into electrical contact with an output, or second, conductor 27. As can be seen more clearly in FIG. 4, the output conductors 27 are disposed in respective trenches, or grooves disposed about the interior periphery of the chamber 31 in the housing 23.

Each of the respective second conductors 27 are connected with pins 41 in the illustrated embodiment of FIG. 3. Expressed otherwise, the plurality of respective pins 41 are connected with respective conductor strips 27 and are adapted to electrically conductively mesh with female conductive receptors on the plug such as plug 19, FIG. 2.

As will be appreciated, it is relatively immaterial whether the input conductors are connected with the respective wheels and the output conductors have electrical contact rotated thereonto; or vice versa; as long as the respective electrical interconnections can be made.

Figure 7A:
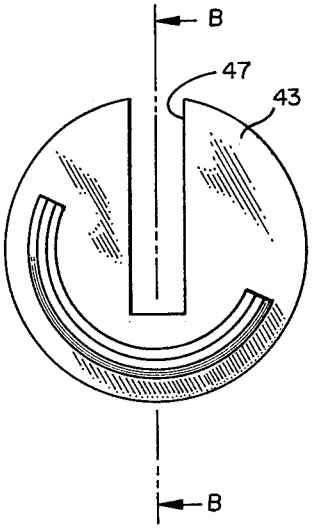
FIG. 7*a* is an end view of the selector wheel of FIG. 3.
Figure 7B:
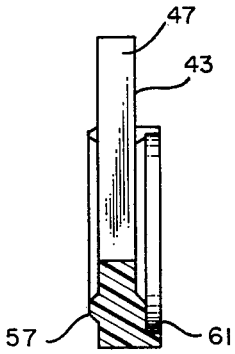
FIG. 7*b* is a side elevation view taken along the lines b—b of FIG. 7*a*.
Figure 7C:
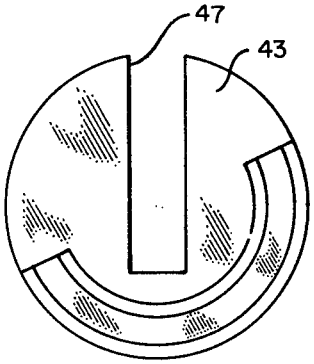

Each respective wheel means 21, as illustrated in FIGS. 3, 7a–c, includes a non-conductive wheel 43 disposed adjacent the respective contactor plate 39 on one side, and include an electrically conductive member 45 disposed in a slot 47, FIG. 7b. As can be seen in FIG. 3, the electrically conductive member 45 is wider than the wheel 43 so as to make electrical contact with the contactor plate 39 throughout rotation. As seen in FIG. 4, the member 45 is biased outwardly by spring 51 to maintain its outer end in electrically engaging contact with the respective contactor strips 27 serving as the second conductor. Thus, when a respective wheel is rotated, its first conductor 25 is rolled into electrical contact with an output, or second, conductor 27.

An insulator plate 53 is disposed on the other side of a contactor plate 39 and prevents electrical contact between contactor plate 39 and an adjacent member 45a, FIG. 3.

As can be seen in FIG. 3, an insulator 53 is disposed between the last contactor plate 39 and biasing means such as springs 55 which bias the entire assembly of wheel means, including the members 45, contactor plate 39 and insulator plates 53 together to maintain the desired electrical contact between respective contactor plates and members 45. Respective biasing means such as springs 55 are held in place by the means for retaining the respective wheel means within the housing 23.

The means 29 for retaining the wheel means within the housing may comprise a threadedly engaging fitting, a chemically adhered means or any other suitable means appropriate to the design of the housing and the respective pins 35. As illustrated, the means 29 for retaining the wheel means within the housing comprises an insert of plastic or the like that is fittingly engaged within the recess within the housing and chemically adhered in place as by Loc-Tite. As is recognized, Loc-Tite comprises polymethylmethacrylate which is suitably catalyzed into adhering, set, state to firmly hold the subassemblies within the housing 23. Any other suitable chemical adhesive such as epoxy or the like can be employed; as can the delineated threads, screws, bolts and nuts and the like. The advantage of the chemically adhered insert is that is serves to seal the housing against the invasion of foreign material such as moisture, dirt and the like.

To further enhance this sealing of the housing, suitable seal means 57 are employed on each of the respective wheels so as to form a seal adjacent the window 59, FIG. 3, at which access is had to rotate the respective wheel means 21. Expressed otherwise, the respective wheels have a respective recesses 61 for sealingly receiving the contact strip and fit within the housing with the insulator disc 53 sealingly engaging an adjacent seal means 57 so as to exclude the foreign matter from the interior of the housing. The housing window 59 also sealingly and fittingly engages the periphery of the respective wheel means 21.

In operation, a male pin 41 electrically engages respective female conductive receptor on the plug 17 when the plug 17 is plugged into the switching connector 15. The respective electrical conductor 25, being a wire in the illustrated embodiment electrically connect a respective pin 41 with a contactor plate 39 in electrical engagement with a member 45 on a respective wheel means. Thus, the electrical control such as the tail lights can be turned on inside the towing vehicle. The wheel means 21 are rotated in turn until electrical continuity is evidenced from a given wheel means onto a system on the towed vehicle 13. Once a given wheel means 21 has been found to convey that electrical current, it is rotated until electrical contact is shown by the end system such as the tail light. As will be recalled, electrical continuity is achieved thru pins 41 which engage female type connectors in the plug 19 connected with the towed vehicle 13. The control such as the tail light switch is then turned off and another control turned on. The second control may be, for example, left turn signal. The other wheels such as the remaining five wheels in the illustrated embodiment, are rotated until evidence is had that the second control is electrically connected with that wheel. Thereafter, the wheel is rotated until electrical output on the second conductor is evidenced on the end system; for example by the left turn signals being operative on the towed vehicle 13. Thereafter, the electrical control is turned off and a third electrical control turned on; for example, right turn signal. In similar manner, then the remaining wheels are rotated until the wheel being electrically connected with that control is found. Thereafter, that wheel is rotated until right turn signals are indicated to be energized. Then the right turn signal is turned off and another electrical control energized. For example, it may be the electric brakes. Thereafter, one of the remaining wheels that is electrically connected with the control is rotated to rotate the electrical output onto that system on the towed vehicle. The same generalized operation is continued until all of the operative pins are correctly and matingly engaged such that the controls on the towing vehicle control the correct system on the towed vehicle.

Thus it can be seen that this system allows easy mating of respective electrical systems of the towed and towing vehicles, regardless of whether or not they are initially correctly matingly designed in their electrical systems and plugs.

Figure 8:
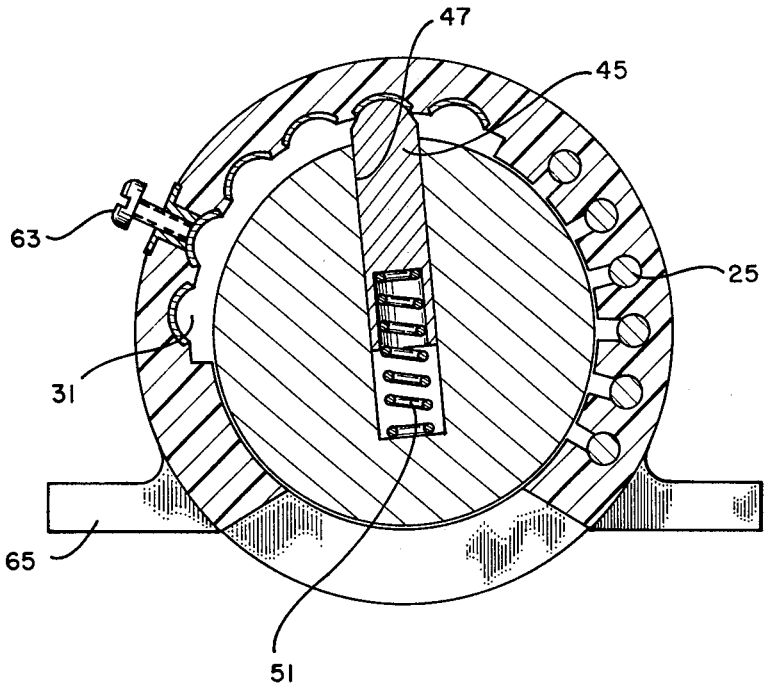
FIG. 8 is a cross-sectional view of an embodiment similar to FIG. 4 designed for broad use in the electronic industry, process control, or the like; and having mounting flanges on the outer housing.

Referring to FIG. 8, essentially the same system and apparatus as has been described hereinbefore is operative and the same reference numerals are employed as are employed on FIG. 4. The difference may be, for example, that external screws 63 may be connected with the respective conductor strips 21 and be available for electrical interconnection with outside conductors such as wires from control channels on sound equipment or the like. Also, mounting flanges 65 are provided to facilitate mounting of the small switching connector as unobtrusively as desired. Only one screw is illustrated in the embodiment of FIG. 8, although it is readily apparent that each of the respective contact strips 27 will have its own contact screw exteriorly of the housing. Similarly, each of the respective input, or first conductors 25 may have any sort of exterior connector desired ranging from input conductors illustrated in FIG. 3 to the screws 63 illustrated in FIG. 8.

Moreover, it should be realized that, while respective plugs 17, 19 have been illustrated in FIGS. 1 and 2, the interconnection between a towing vehicle and the towed vehicle can be made from either sockets on the towed vehicle or sockets on the towing vehicle rather than having respective plugs; and the switching connector of this invention is still uniquely advantageous in principle, although the structure may be altered slightly to accomodate different types of receptacles.

From the foregoing, it can be seen that this invention accomplishes the objects set out hereinbefore.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. A multiple input, multiple output combination switching connector for matingly connecting a plurality of first conductors with a plurality of second conductors, comprising:

a. a housing;

b. a plurality of respective input conductors adapted to make electrically conductive contact with the first conductors;

c. A plurality of respective output conductors adapted to make electrically conductive contact with the second conductors;

d. a plurality of respective wheel means for rotating a respective input conductor into electrical contact with a respective output conductor; each said wheel means including an electrically conductive path having an electrical conductor, and electrically conductive contact connected with a respective input conductor and an electrically conductive output contact adapted to be rotated into electrical contact with a respective output conductor; said wheel means being individually rotatable within said housing;

e. means for retaining said wheel means within said housing with their respective electrically conductive paths intact and insulated from other respective said wheel means and their respective electrically conducted paths;

f. a window for exposing said wheel means for rotation; and g. seal means for excluding dirt, moisture and the like adjacent said window where said wheel means are exposed for rotation.

2. The connector of claim 1 wherein respective contactor plates serve as said electrical conductors; said wheel means are non-conductive, include respective conductive members within a slot, said conductive members being biased peripherally outwardly to contact said output conductors, said conductive members being thicker than the remainder of said wheel means so as to maintain electrical contact with respective first sides of respective contactor plates, and respective insulator means intermediate respective second sides of said contactor plates and other said conductive members; said plurality of wheel means being biased together such that each said conductive member maintains electrical contact with its respective said contactor plate and is insulated from electrical contact with others by said insulator throughout rotation whereby a respective said first conductor can be put into electrical contact with the respective second conductor regardless of whether or not they were initially aligned and compatible.

3. The connector of claim 1 wherein it is a trailer connector and said input conductors are adapted to be placed in electrical contact with respective first conductors on a towing vehicle containing the necessary switches, such as electric brake switch, light switch, turn signals and the like; and said respective output conductors are adapted to make electrically conductive contact with respective second conductors on a towed vehicle that has the respective elements which the switches will render electrically energized and de-energized.

4. The connector of claim 3 wherein said housing has two respective receptacles that are adapted to matingly engage two respective plugs on the respective towing and towed vehicles; said input conductors and output conductors are contained within said housing and are adapted for mating plug-type engagement with the first and second conductors when the respective plugs of the towing and towed vehicles are plugged into the respective receptacles of the switching connector.

5. The connector of claim 3 wherein said input conductors are adapted to make electrically conductive contact with respective first conductors in a receptacle on said towing vehicle and said output conductors are adapted to engage said second conductors in a plug connected with said towed vehicle.

6. The connector of claim 3 wherein said input conductors are adapted to make electrically conductive contact with respective first conductors in a plug connected with said towing vehicle and wherein said output conductors are adapted to make electrically conductive contact with said second conductors in a receptacle on the towed vehicle.

7. A multiple input, multiple output combination switching connector for matingly connecting a plurality of first conductors with a plurality of second conductors, comprising:

a. a housing;

b. a plurality of respective input conductors adapted to make electrically conductive contact with the first conductors;

c. a plurality of respective output conductors adapted to make electrically conductive contact with the second conductors;

d. a plurality of respective wheel means for rotating a respective input conductor into electrical contact with a respective output conductor; each said wheel means including an electrically conductive path having an electric conductor; and electrically conductive contact connected with a respective input conductor and an electrically conductive output contact adapted to be rotated into electrical contact with the respective output conductor; said wheel means being individually rotatable within said housing; and e. means for retaining said wheel means within said housing with their respective electrically conductive paths intact and wherein a contactor plate serves as each said electrical conductor; said input conductors comprise wires that are connected with a connector tab on respective contactor plates; said output conductors comprise electrically conductive strips disposed about the periphery and adapted to be respectively engaged by respective conductive members rotated by said wheel means rotation; said wheel means being non-conductive, each including a conductive member within a slot and biased outwardly to contact said contact strips as said wheel means is rotated; said conductive member being thicker than the remainder of said wheel means so as to maintain electrical contact with a first side of said contactor plate, and a respective electrical insulator disposed intermediate respective second side of said contactor plate and other said conductive member; said plurality of wheel means being biased together such that each said conductive member maintains electrical contact with its respective said contactor plate and is insulated from electrical contact with others by said insulator throughout rotation whereby respective said first conductors can be put into electrical contact with respective second conductors regardless of whether or not they were initially aligned and compatible.

* * * * *